US005254203A

United States Patent [19]

Corston

[11] Patent Number: 5,254,203

[45] Date of Patent: Oct. 19, 1993

[54] METHOD AND APPARATUS FOR CONSTRUCTION OF FLOORING TO PREVENT SQUEAKS

[76] Inventor: Charles Corston, 501 Willow Court S., Bellingham, Wash. 98225

[21] Appl. No.: 901,426

[22] Filed: Jun. 19, 1992

Related U.S. Application Data

[63] Continuation-in-part of Ser. No. 761,686, Sep. 18, 1991.

[51] Int. Cl.[5] ..... E04F 21/00; B32B 31/00

[52] U.S. Cl. ..... 156/391; 156/71; 156/577; 118/207

[58] Field of Search ..... 118/108, 207, 208, 305, 118/307; 156/71, 391, 577, 523, 575

[56] References Cited

U.S. PATENT DOCUMENTS

| | | | |
|---|---|---|---|
| 57,091 | 8/1866 | Coe | 118/108 |
| 2,651,276 | 9/1953 | Kristen | 118/305 X |
| 3,537,941 | 11/1970 | Miklos | 156/577 |
| 4,357,198 | 11/1982 | Ezquerro | 156/391 |
| 4,775,442 | 10/1988 | Januska | 156/575 X |
| 4,818,329 | 4/1989 | Tutas | 156/391 |
| 4,849,063 | 6/1989 | McXinnon | 156/391 |
| 4,913,766 | 4/1990 | Löjdström | 156/523 X |
| 5,045,146 | 9/1991 | Rundo | 156/391 |

*Primary Examiner*—Michael W. Ball
*Assistant Examiner*—Charles Rainwater
*Attorney, Agent, or Firm*—Hughes & Multer

[57] ABSTRACT

A method for constructing flooring so as to prevent development of squeaks, by laying a strip of adhesive cushioning tape on the edges of the joists and placing the floor decking on top of this, and also a tool for applying this tape. The tool has a handle for manual operation, and there is an adjustable width head assembly on the lower end of this which enables the tool to engage joists of various widths. This has a central roller flanked by compound wall members. The compound wall members are made up of plate-like wall segments, and these may be displaced vertically on an axle member so as to adjust the width of the guide area which is defined between the wall members.

19 Claims, 7 Drawing Sheets

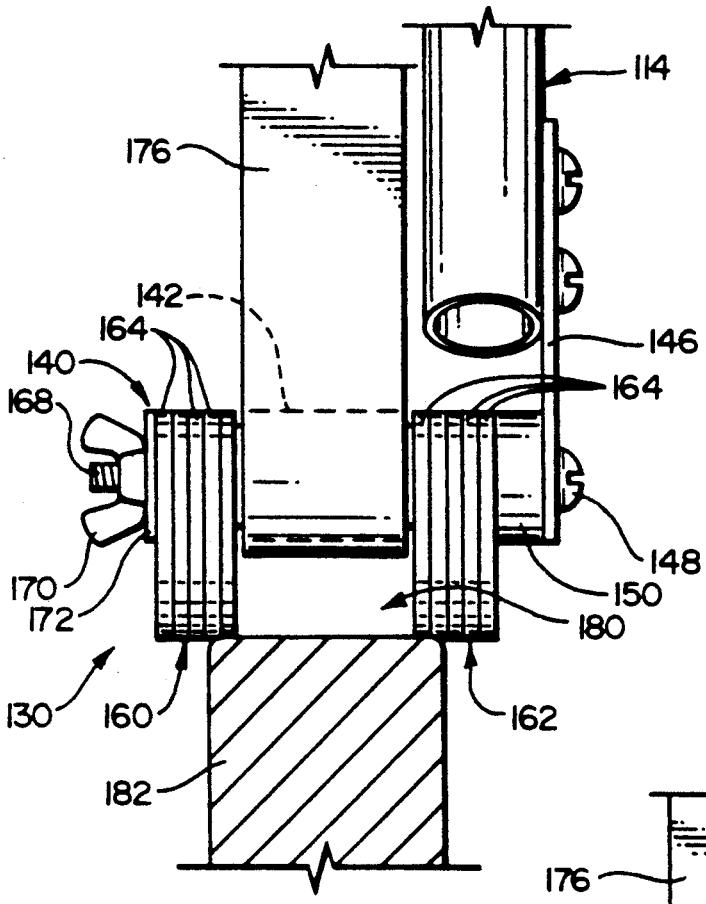
FIG. 10A
FIG. 10B
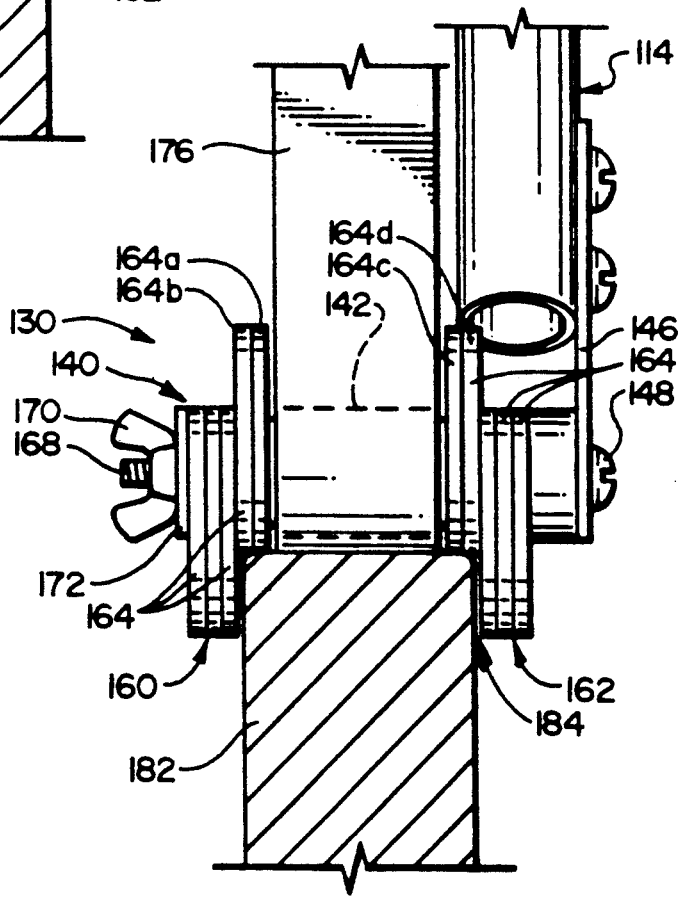

METHOD AND APPARATUS FOR CONSTRUCTION OF FLOORING TO PREVENT SQUEAKS

RELATED APPLICATIONS

This is a Continuation-In-Part Application of copending Application Ser. No. 07/761,686 filed Sep. 18, 1991.

FIELD OF THE INVENTION

The present invention relates generally to the construction of buildings having floor joists, and, more particularly, to a method for constructing such structures with a layer of cushioning material between the floor joists and the floor decking so as to prevent the development of squeaks in the finished structure.

BACKGROUND OF THE INVENTION

In most houses and many similar structures, the floors are conventionally constructed by installing a series of narrow floor joists to provide support, and then placing sheets of plywood or the like on top of these to form the flooring surface. The sheets of plywood are nailed to the joists, and then carpet, linoleum, or other floor covering is typically installed on top of the plywood.

Due to the increasing expense and difficulty of obtaining fully seasoned wood products, there has been an increasing tendency to install joists which are not as fully seasoned, nor perhaps as true, as the builder might otherwise like. Unfortunately, once the wood fully dries, its curvature often changes, and the resulting irregularities and misalignment of the edges of the joists with the overlying plywood frequently results in numerous floor squeaks in the finished building. These squeaks often occur due to the plywood rubbing up and down against the shaft of a nail, where there is a gap between the top of the joist and the plywood which permits the plywood to flex up and down as a person or other object moves across the floor. Because it is usually necessary to remove a ceiling and/or carpeting or other floor covering to get at the source of the problem, repairs to correct such squeaks are typically very expensive.

The conventional measure which has been adopted in the construction industry in an attempt to overcome the problem of floor squeaks is to glue the plywood sheets to the joists using a conventional wood glue or the like. This technique has been marked by very modest success. Very commonly, once the wood has dried out, the resulting irregularities and misalignments become so great that the dried glue simply cracks or breaks and so does nothing to prevent the squeaks from developing. Also, because such glues set up within a limited period of time after they have been dispensed from their containers, the builder is obliged to place the plywood on the floor joists almost immediately after the glue has been laid thereon, which interferes with the builder's flexibility in managing the project; furthermore, in very hot or very cold climates, the glue tends to set up excessively fast, which aggravates this problem. Also, most such glues cannot be used when it is raining. Still further, once the glue has been placed on the floor joists, the construction crew can no longer walk about on the tops of the joists, which makes it very difficult to position and install the sheets of plywood, and when the crew slides the sheets of plywood along the tops of the joists into place, the edges of the sheets often scrape the glue off of the joists so that there is virtually none left to bond to the plywood.

An additional problem which is encountered when using the conventional construction methods described above is a lack of sound insulation between vertically adjoining rooms, as in an apartment complex. Impact noises, such as those of a person walking or dropping an object on the floor, are readily transmitted directly through the floor joists to the ceiling of the room below. While systems have been proposed for sound insulation of such floors, these have normally been prohibitively difficult and expensive to construct, particularly for use in low-cost construction projects such as public housing apartments, motels, and the like. And, of course, the conventional glueing technique described in the preceding paragraph does nothing to prevent the transmission of impact noises through the floor joists.

Accordingly, there exists a need for a method of constructing the floors of houses and like structures which eliminates squeaks, and which compensates for irregularities and misalignments which occur when the wooden floor joists dry out. Furthermore, there is a need for such a method which can be readily practiced in a variety of weather conditions, and which eases the task of moving about on the floor joists to align and install the sheets of plywood flooring. Still further, there exists a need for such a method which helps reduce the transmission of impact sounds in a vertical direction between adjoining rooms in a structure.

SUMMARY OF THE INVENTION

The present invention has solved the problems cited above, and comprises generally a method of constructing the floor of a structure so as to prevent squeaking of the floor due to movement of the decking relative to the underlying joists. The method comprises the steps of installing a floor joist and laying a strip of adhesive cushioning tape on an upper edge of the joist so that an adhesive side of the tape adheres thereto so as to keep the strip in position, and so that a non-adhesive side of the tape faces upwardly therefrom, this adhesive cushioning tape being formed of a resiliently compressible material. The floor decking is placed on top of the strip of cushioning tape so that the tape is sandwiched between the decking and the joist, and the decking may be slid over the non-adhesive surface of the strip of tape to a desired position. Fasteners are then driven through the floor decking and into the joist so as to secure the decking in the desired position, and so that the resilient cushioning tape is partially compressed and fills any gaps between the upper edge of the joist and the decking so as to prevent the decking from moving on the joist and causing squeaks.

Also in accordance with the present invention, there is a tool for applying the adhesive cushioning tape to the upper edges of the floor joists. This comprises a handle member having upper and lower ends and middle portion. A roller member is mounted to the lower end of the handle member so as to enable the operator to apply downward pressure on this against the edge of the joist. A guide member is mounted to the lower end of the handle member, and this has a guide area for engaging the edge of the joist so as to guide the roller along this in a forward direction; the guide area is adjustable in width so as to enable the guide member to engage joists having various widths. A spool member is mounted to the handle member for unwiding a roll of tape so that the adhesive side of this is exposed, and means are provided for feeding the tape under the roller member so that the adhesive side is pressed against the edge of the joist by the downward pressure on the roller.

The means for feeding the tape under the roller member may be the guide member, and this may comprise first and second parallel wall members which are spaced apart so as to define the guide area. At least one of these wall members may be a compound wall structure comprising a plurality of wall segments positioned in side-by-side relationship, each of these wall segments being selectively displaceable so that the width of the guide area is adjustable by displacing segments which lie adjacent to this. The roller member may be positioned intermediate these wall members and over the guide area.

Preferably, the guide member further comprises means for selectively locking the side-by-side wall segments together, so that in a released position the segments are selectively displaceable so as to adjust the width of the guide area, and in a locked position the wall segments are locked together so as to maintain the guide area at the selected width.

There may be an axle member which extends through the roller member and through elongate slots in the wall segments; this is configured to permit vertical displacement of the segments relative to the axle, but to cooperatively engage the slots so as to prevent the segments from rotating around the axle member. Accordingly, the axle member may be substantially square in cross section, and the slots in the wall segments may be correspondingly rectangular in shape.

The wall segments may be flat, plate-like members stacked together in side-by-side relationship. The means for locking these together may comprise a base member mounted on a first end of the axle so as to abut an outermost segment of the first wall member, and an adjustable nut member threadably mounted to a second end of the axle member so as to abut an outermost segment of the second wall member. Thus, in response to slackening of the nut member the segments are released so as to permit adjustment of the width of the guide area, and in response to tightening of the nut member, the wall members are compressed between the nut member and the base member against the ends of the roller member so that the wall segments are forced into locking frictional engagement with one another.

Objects and advantages of the invention not clear from the above will be understood by a reading of the detailed description of the invention and a review of the accompanying drawings.

BRIEF DESCRIPTION OF THE DRAWINGS

FIG. 10A is a front, elevational view of the head portion of the tool of FIGS. 8–9, showing this positioned against the upper edge of a floor joist in preparation for adjusting the width of the guide assembly to receive this joist; and FIG. 10B is a front, elevational view similar to that of FIG. 10A, showing the width of the guide assembly having been adjusted so that the edge of the joist is received in this and the roller member is positioned adjacent the top of the joist.

DETAILED DESCRIPTION

Figure 1:
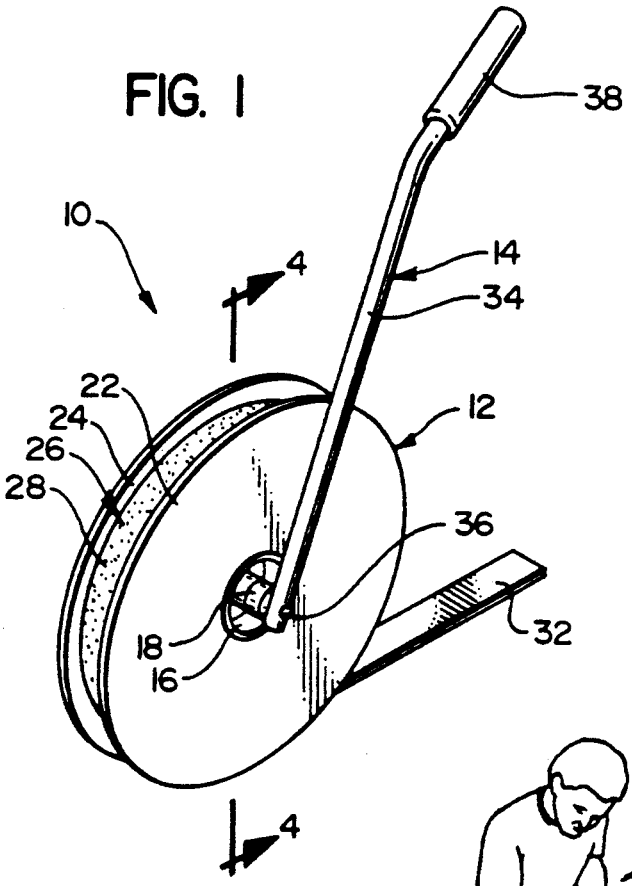
FIG. 1 shows a perspective view of a hand-operated tool for applying an adhesive strip of cushioning tape to the top of a floor joist in accordance with the present invention.

FIG. 1 shows a hand-operated tool 10 for applying adhesive cushioning tape to the top of floor joists in accordance with the present invention. Tool 10 comprises generally a spool portion 12 and a handle portion 14. As will be described in greater detail below, spool portion 12 is provided with a central hub 16 which receives and rotates about an axle 18 which extends from the handle portion of the tool. First and second flanges 22, 24 extend from hub 16 and, as will be described below, are spaced apart to form a gap which receives the top edge of the floor joist. A roll of adhesive cushioning tape 26 is contained between the two flanges 22, 24, and this is wound on the roll in a "reverse" manner so that the adhesive side 28 of the tape faces outwardly on the roll, contrary to the usual arrangement of rolls of adhesive tape. Consequently, as the roll of tape is rolled along an underlying surface (i.e., the floor joist), the adhesive side 28 of the tape adheres thereto so that the tape unrolls from the spool, leaving the non-adhesive side 32 of the tape exposed and facing upwardly from the joist.

As noted above, axle 18 is a part of handle portion 14; in the embodiment illustrated, axle 18 is mounted at right angles to the lower end of a rod-like handle 34 by means of a bolt 36. Preferably, handle 34 may be about 2' in length with the length of 22" being an excellent compromise in terms of both handling ease and convenience when packaging for distribution (using standard 24"-long boxes). Handle 34 may be fabricated of any suitable material; ¾" tubular metal electrical conduit has been found to be an eminently suitable material for this application, from the standpoint of low cost, ease of fabrication, and light weight. The upper end of handle 34 is bent slightly rearwardly (e.g., about 10°-20°) from the main shaft of the handle to provide a more horizontal portion which can be conveniently held in the hand of a standing operator. A hand grip 38 is installed on the upper end of handle 34 (for example, a cushioning foam rubber hand grip), and the open upper end of the tubular handle itself may preferably be closed by a suitable plug (not shown).

The use of tool 10 to install the adhesive cushioning tape in accordance with the method of the present invention will be discussed below. However, before proceeding to that, a description of the tape material itself will be provided. The width of the tape preferably corresponds generally to the width of floor joist on which it is to be installed; for most typical residential construction, floor joists are 2"×8", 2"×10", or 2"×12" boards, which have edge thicknesses of roughly 1½-1⅝", and so the tape may preferably be cut to about this width, with a width of about 1 7/16 inch having been found suitable for use with the vast majority of joists.

The adhesive cushioning tape essentially forms a resilient gasket between the floor joists and the overlying decking material (e.g., sheets of plywood), and serves several functions: firstly, the tape provides a compressible material which compensates for or "smooths out" irregularities and discontinuities between the plywood and the underlying floor joist so as to eliminate any gaps which would permit the plywood to work up and down and cause squeaks, and secondly it serves a shock-absorbing function which helps prevent the transmission of sound vertically through the floor. The tape is thus preferably fabricated of a resilient, shock-absorbing material, and an eminently suitable material for this is flexible closed-cell polyethylene foam of about 4 pound density; other examples of material which may be suitable include vinyl and rubber foam. Unlike conventional glue, the polyethylene foam material retains its resilience indefinitely, with the life expectancy of this material in service being roughly equivalent to that of the house itself. Suitable thicknesses for the tape have been found to range from about ¼" thick downwardly, with 1/16" being preferable for many applications. When it is installed beneath nailed-down plywood decking, the foam tape compresses to a certain degree; for example, it may condense down to about 50% of its original thickness. However, even when partially compressed, it retains the necessary resilience to perform the functions noted above.

The adhesive side 28 of the tape is impregnated or coated with a suitable adhesive material, such as a permanent rubber-based pressure sensitive adhesive having a coating weight of about 4 grams, with this preferably being sufficiently soft and adhesive to adhere to bare wood, even if somewhat damp. The non-adhesive side 32 of the tape is preferably tough and slick so as to permit the plywood sheets or other decking to be slid over this without damaging the tape. This may be accomplished by covering the adhesive side of the tape with a thin (e.g., 1-4 mil) polyester liner which is adhered to the underlying foam tape with a thin layer of adhesive; for example, a 2 mil polypropylene liner underlain by a 1.5 gram coat of the rubber-based adhesive has been found to be a suitable construction. Alternatively, the non-adhesive side of the tape may be covered with a release paper, or may be sealed with an integral coating or by heat-sealing. Consequently, it will be understood that, for most applications, it is not intended that the tape serve to "glue" or hold the overlying plywood or other decking in place, the intended purpose of the adhesive rather being to facilitate the laying of the strip of tape and holding it in place until the plywood flooring is laid on top of it. Because the upper surface of the tape is non-adhesive, the personnel installing the floor can walk about on top of the tape after it has been put down, and can easily slide the plywood sheets into position over the surface of the tape without these catching or sticking on the tape and damaging it. The plywood sheets (or other decking) are then secured in place by nails, screws, or like fasteners. Of course, use of the cushioning tape as described above also eliminates the problems of excessively quick setting-up times which are associated with the use of conventional glues.

Figure 2:
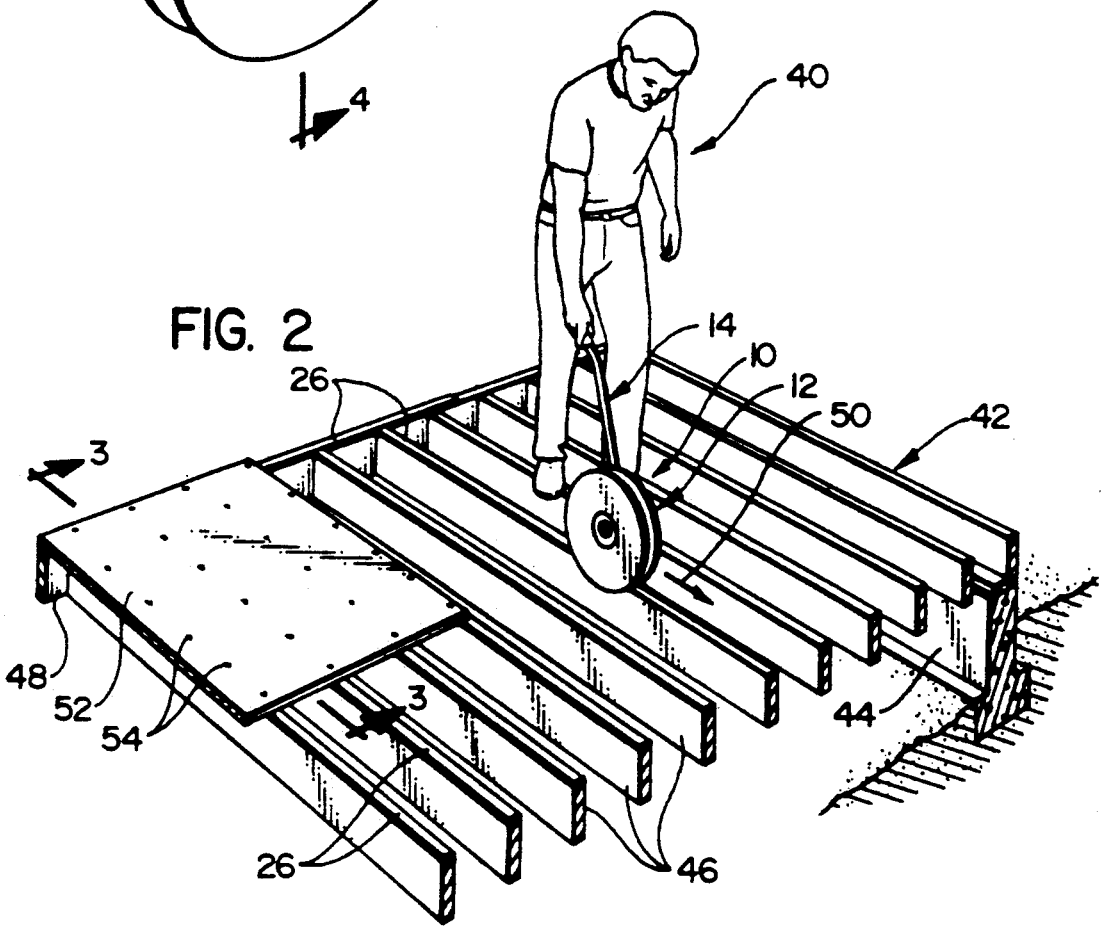
FIG. 2 shows a perspective view of an operator employing the tool of FIG. 1 to lay the strips of adhesive cushioning tape on top of installed floor joists, with a sheet of plywood floor decking being shown installed on top of a portion of these.

FIG. 2 shows an operator 40 using the tool 10 to install the above-described adhesive cushioning tape in a floor system 42. Floor system 42 is provided with a generally conventional foundation 44, which supports a series of parallel, spaced apart floor joists 46 joined together at their ends by headers 48. As was noted above, for residential construction the floor joists 46 may typically be 2"×12" boards or the like, laid on edge.

To lay the cushioning adhesive tape on top of these floor joists, the operator unrolls a bit of the tape and starts this at the desired point on the joist, and then slips the top of the joist into the circumferential channel formed between the two flanges of the spool so that the outer adhesive surface of the roll of tape contained therein contacts and adheres to the joist. The operator then grasps hand grip 38, and, using handle 34, rolls spool 12 along the top of the floor joist in the direction indicated by arrow 50. As this is done, the tape unrolls from the spool and is laid in place on top of a joist. If desired, the tape can also be laid along the top of the header 48, as is shown in FIG. 2. The plywood sheets 52 which make up the decking of the floor are then slid into place, with the operators being able to walk about on the non-adhesive surface of the tape and slide the sheets of plywood across this as previously described without fear of damaging the tape or getting the plywood stuck in the wrong spot. Once the plywood sheet has been positioned in its desired final location, the installation is completed by nails 54 or like fasteners, which are driven through the plywood 52 and tape 26 into the wooden floor joist 46.

Figure 3:
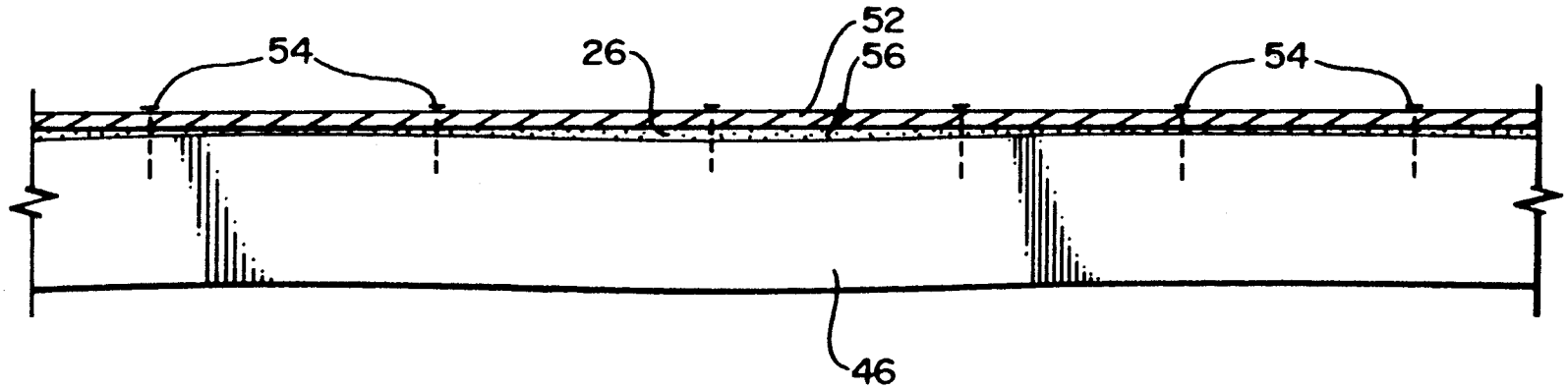
FIG. 3 is a cross-sectional view taken along line 3—3 of FIG. 2, showing one of the strips of resilient cushioning tape partially compressed between a joist and the overlying plywood decking, and filling a gap between these so as to prevent the plywood from working up and down against the shanks of the nails.

FIG. 3 shows a cross-section through the flooring system having the cushioning tape installed between the upper edges of the joists and the overlying plywood decking as described above. In particular, FIG. 3 shows how the uneven upper edge of a joist 46 (which may be the result of warping or bowing of the joist as it has dried out, as discussed above) causes discontinuities or gaps 56 between it and the planar sheet of plywood 52, which, if left unfilled, would permit the plywood to flex up and down as people walked across it, causing squeaks as the plywood worked against the shanks of nails 54. However, the resilient cushioning tape 26 installed in accordance with the present invention is partially compressed between the joist and the plywood so that this smooths out these irregularities and fills the gaps 56 so as to prevent the plywood from flexing downwardly by any appreciable distance under a person's weight. Furthermore, floor decking is typically installed using ring nails; as these are driven through the strip of resilient cushioning tape, a portion of this material is picked up in the grooves along the shank of the ring nail, and in the event that the nail subsequently lifts (as, for instance, if the space between the nails is excessive and the plywood bows due to becoming wet), the cushioning material which is retained along the shank of the nail serves as additional assurance against squeaks developing. The insulating layer provided by the cushioning tape also eliminates the direct wood-to-wood contact between the plywood and the joist, so as to prevent impact noises from being transmitted from the plywood to the joist and so to the ceiling of the room below.

Having completed a description of the major components and aspects of the present invention, a number of additional aspects of the tool and method incorporating the present invention will now be described.

Figure 4:
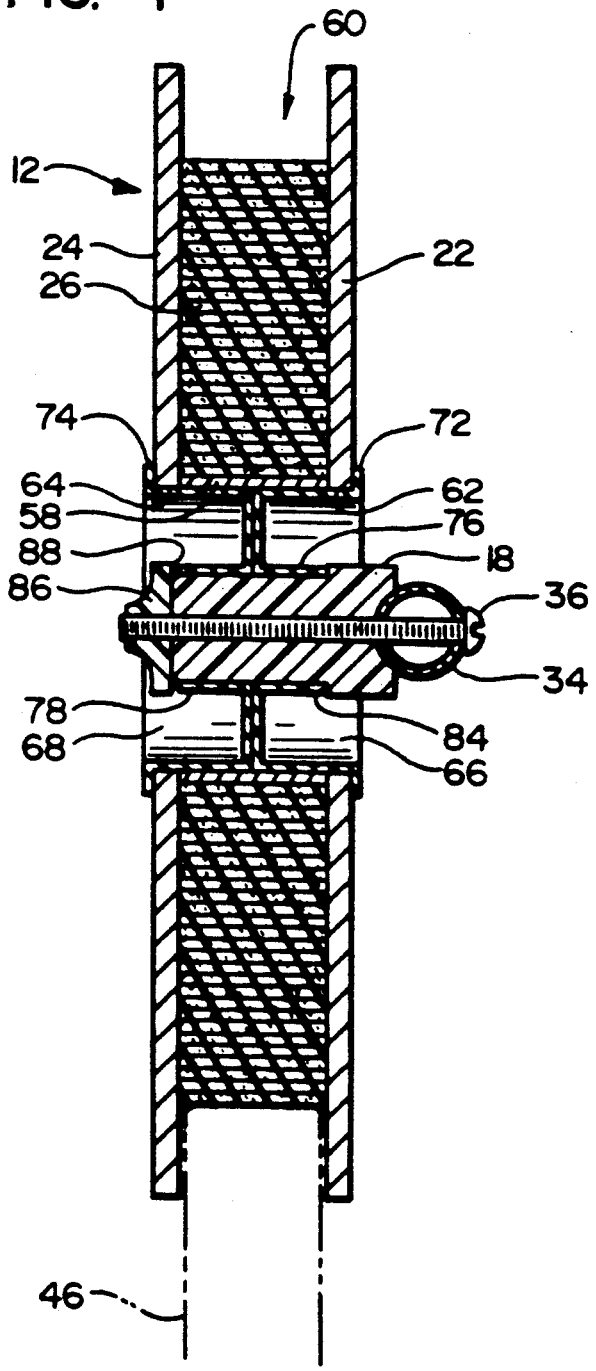
FIG. 4 is a cross-sectional end view taken along line 4—4 of FIG. 1, showing the configuration of the tape spool of the tool and how this fits onto the top of a floor joist.

FIG. 4 shows a cross-sectional view of the spool portion 12 of tool 10. For reasons of economy, the rolls of tape 26 are supplied from the manufacturer wound on small, cylindrical cardboard cores 58; as each of these rolls becomes depleted, it is removed from the spool and replaced with a fresh one. To assemble spool 12, one of these rolls of tape is placed between the two parallel, circular flanges 22, 24; since the width of the tape is sized to correspond to the edge width of the joist 46, the two parallel flanges 22, 24 are spaced apart from one another by the roll of tape so as to form a peripheral recess or channel 60 which receives the upper edge of the joist so as to guide the spool as this is pushed along by the operator. The circular flanges 22, 24 (which may be formed of heavy duty cardboard, plastic, or other suitable material) each have a circular central opening 62, 64 having a diameter which corresponds generally to the inside diameter of the cardboard core 58. To secure the flanges to the roll of tape, drum-like, preferably identical inner and outer hub halves 66, 68 are inserted through each of the openings 62, 64; the external diameters of the hub halves are sized to form an interference fit with the inner surface of cardboard core 58, and may be provided with external ribbing to enhance this engagement. They are also each provided with a radially extending outer flange 72, 74 which abuts the outer surface of the associated circular flange 22, 24 adjacent to its central circular opening so as to hold this against lateral movement.

Each of the hub halves 66, 68 has a cylindrical central sleeve portion 76, 78, and these line up coaxially with one another when the hub halves are installed, so as to form an axial central bearing sleeve for the spool portion. This receives the stub axle 18 which extends from the end of handle 34, so that the spool rotates freely thereon. Stub axle 18 may be formed of a suitable, low friction material such as nylon, for example, and has a semi-cylindrical groove formed on its inner end which abuts the outer wall of the cylindrical shaft of handle 34 so as to prevent rotation of the stub axle relative thereto. A radially extending shoulder 84 is also formed about axle 18 near its inner end, and this limits the lateral motion of the spool assembly in this direction so as to keep it spaced away from the shaft of handle 34. The outer end of stub axle 18 extends through sleeve portions 76, 78; a bolt 36 also extends axially through axle 18 to its outer end, where a wing nut 86 is threaded onto the end of the bolt so as to retain the spool on the axle. Wing nut 86 has a radially extending flange portion 88 which abuts the outer end of sleeve portion 78 so as to limit lateral movement of the spool in this direction, and wing nut 86 may also be fabricated of a suitable material, such as nylon, for minimizing friction at this contact point.

Figure 5:
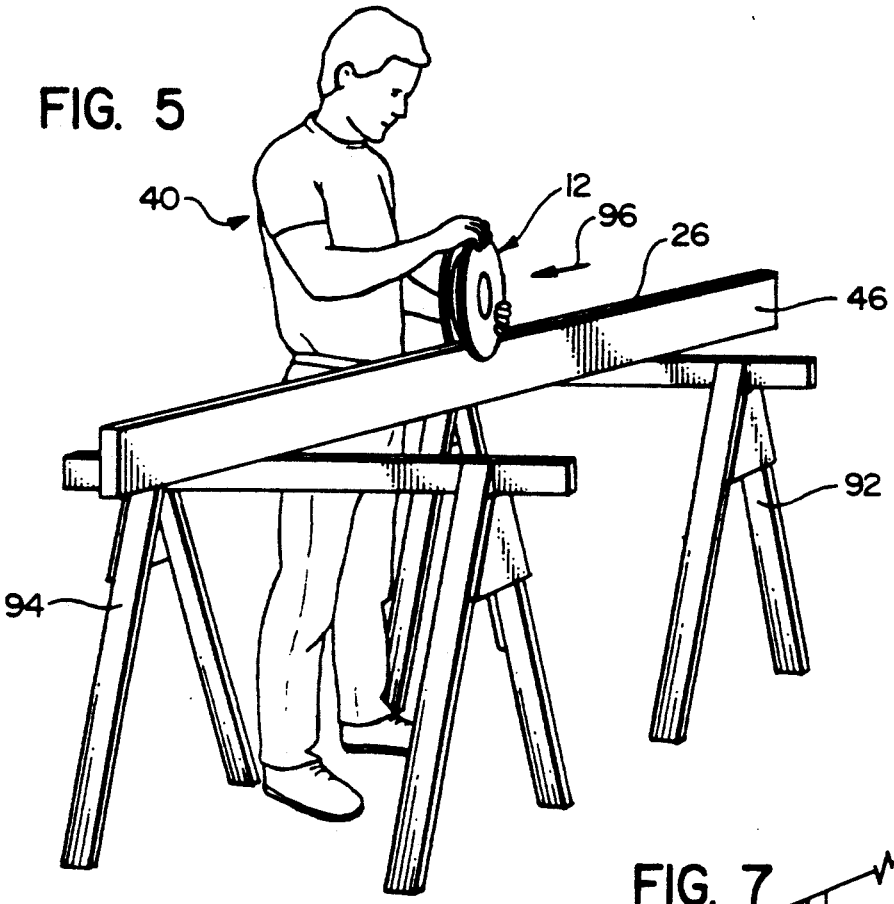
FIG. 5 is a perspective view of an operator using a spool of the cushioning adhesive tape similar to that shown in FIG. 1, but without the handle assembly, to lay a strip of the tape on top of a joist prior to its installation.
Figure 6:
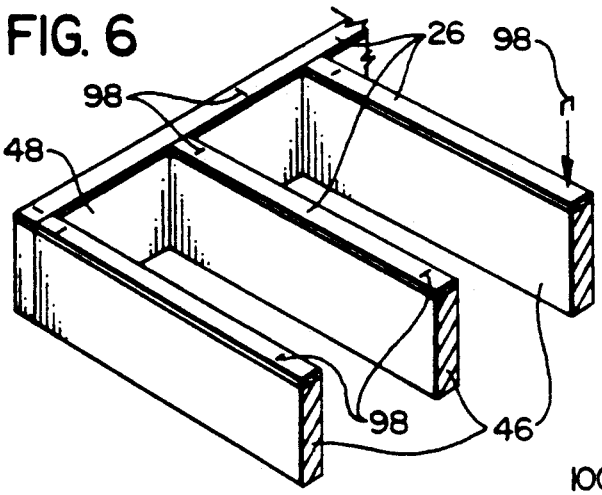
FIG. 6 is a perspective view somewhat similar to that of FIG. 2, showing the use of staples to assist in holding the adhesive cushioning tape in place in conditions where the joists are so wet as to interfere with the tape initially adhering thereto.
Figure 7:
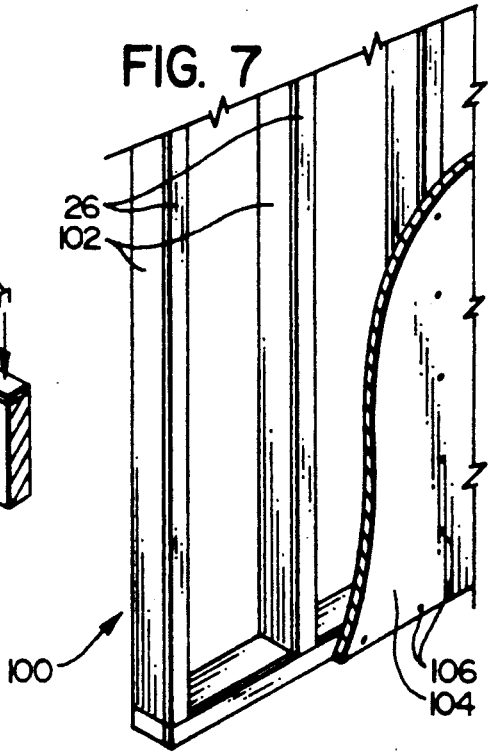
FIG. 7 is a perspective view of a portion of a vertically extending wall, with strips of the adhesive cushioning tape having been laid on the edges of the studs thereof in accordance with the present invention, and sheets of wallboard or the like having then been installed on top of these.

FIGS. 5–7 illustrate additional techniques which may be used for implementing the method of the present invention. FIG. 5 shows the operator 40 laying the strip of adhesive tape 26 on a floor joist 46 prior to this being installed, which technique lends itself to the construction of upper floors of a house or wherever conditions render it preferable to lay the tape strip on the joist prior to the latter being put in place in the structure. To do this, the spool portion 12 can be grasped in the operator's hands as shown in FIG. 5, and rolled along in this manner in the direction indicated by arrow 96 to lay the strip of cushioning tape on the upper edge of joist 46.

FIG. 6 shows the use of staples 98 to help hold the strips of adhesive cushioning tape 26 on the upper edges of the floor joists 46 after they have been laid out thereon. This technique may be desirable when the conditions are so wet that the adhesive material of the cushioning tape alone has difficulty holding the tape in place.

FIG. 7 illustrates the use of the present invention in the construction of a vertically extending wall system 100. This approach provides an inexpensive and effective approach to sound insulation of walls so as to prevent the transmission of sound therethrough to adjoining rooms. The strips of cushioning tape 26 are laid on the edges of studs 102, using techniques similar to those described above, and then a suitable wall surface material such as plasterboard 104 is laid over this and secured in place using nails 106 or other suitable fasteners.

Figure 8:
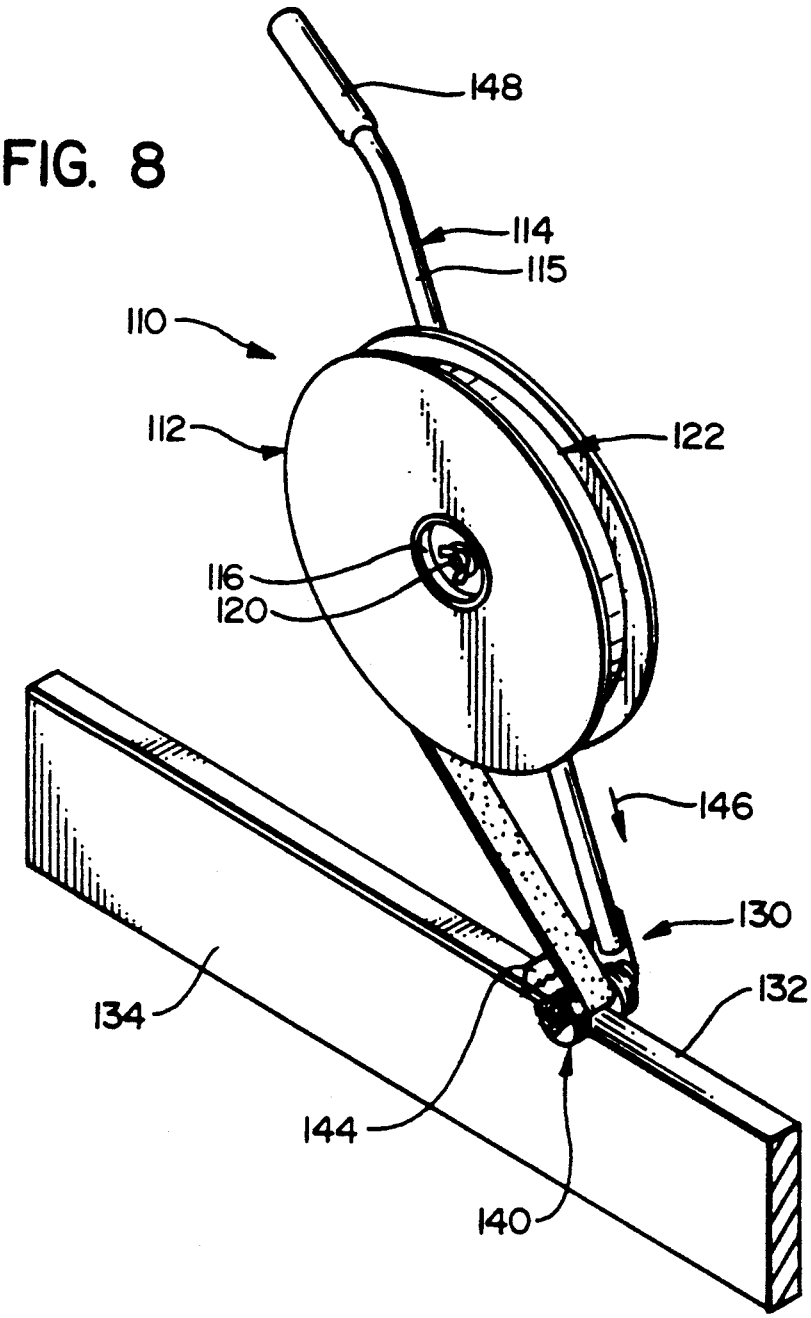
FIG. 8 is a perspective view of a second hand-operated tool for applying the cushioning tape to the tops of floor joists in accordance with the present invention, this having the adjustable-width guide assembly on its lower end for receiving floor joists of various widths.

FIG. 8 shows a second configuration of hand-operated tool 110 for applying a strip of the cushioning tape to joists. This embodiment of tool has been found desirable for use in those circumstances when additional pressure is desired to press the tape against the joist so that this firmly adheres to the wood, as when this is slightly damp. Furthermore, the head of this tool is provided with an adjustable-width guide assembly, so that this single tool is able to engage the edges of joists having various widths. This is a particularly valuable feature, not only because the edge widths of conventional floor joists vary considerably due to irregularities in manufacture and quality control, but also because of the increasingly widespread use of fabricated floor joists. These fabricated joists are built-up members which may be constructed of plywood, and many resemble an I-beam in form, with upper and lower plywood flanges interconnected by a vertical plywood web. The widths of the flanges vary considerably depending on the size of the joist, and typically range from about 1¼" to about 2½". The guide assembly of tool 110 is configured so that this can be adjusted to receive the edges of joists having these various widths, and then guide the tape down the centers of these joists, thus vastly increasing the versatility of the single tool.

As before, tool 110 is provided with both a spool portion 112 and a handle portion 114. In this case, however, the spool portion is mounted a spaced distance from the end of the handle, preferably somewhere near the midpoint of the shank portion 115. The spool portion 112 is generally similar in construction to the spool assembly described above with respect to FIG. 1, this having a hub 116 and stub axle 118 (not shown) which are mounted to the handle by an axle bolt 120. A roll of the adhesive tape 122 is mounted on the hub portion of the spool in the manner previously described; however, the inner and outer flanges are dispensed with, inasmuch as the spool assembly itself is no longer required to engage the edge of the joist in this arrangement.

Unlike the first embodiment of tool described above, the tape may be wound on spool 112 in a conventional fashion, with its adhesive side facing inwardly, this being advantageous from the standpoint of economy. The tape is taken off the rearward side of the spool, and is led downwardly and under the head assembly 130 at the lower end of handle portion 114. As will be described in greater detail below, head assembly 130 is made up generally of a guide assembly 140 which flanks a roller member 142 (not shown in FIG. 8, but shown in FIGS. 10A–B), and also a cutter member 144 which is mounted rearwardly of the roller member and guide assembly. The tape strip is led between the vertically extending walls which are defined by the guide assembly, so that this passes in front of and then under the roller; as the tape passes under the roller, it is pressed firmly against the edge 132 of the joist 134 by pressure which is exerted through the handle of the tool in the direction indicated by arrow 146. To facilitate application of this downward force while moving the tool in a forward direction, the upper end of the handle portion is fitted with a rearwardly angled hand grip 148.

Figure 9:
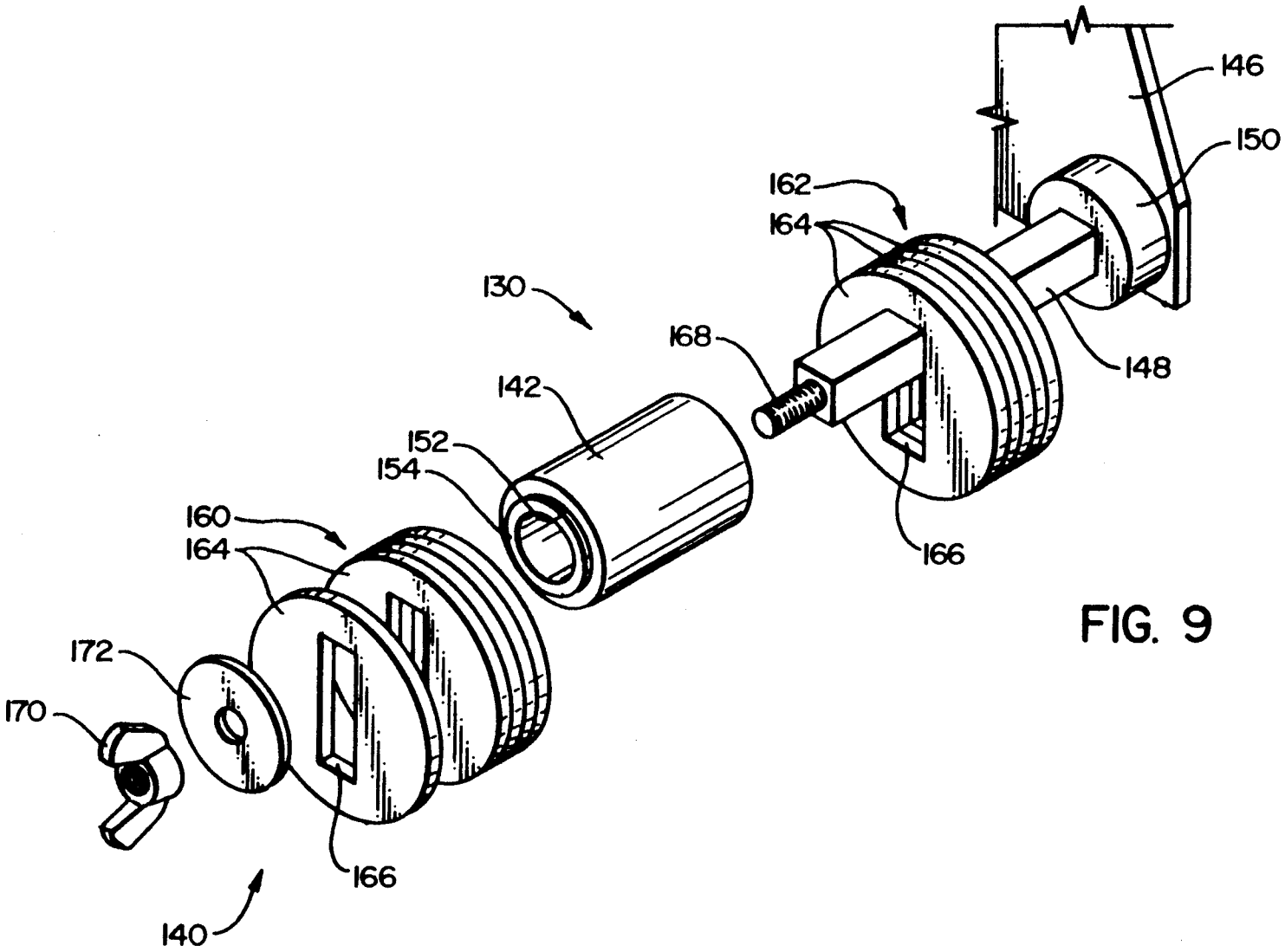
FIG. 9 is an exploded view of the head portion of the tool of FIG. 8, showing the construction of the adjustable-width guide assembly, and how this flanks the roller member for pressing the tape strip against the joist.

FIG. 9 shows the head assembly 130 in greater detail, this being an exploded view of the roller member and the associated guide assembly. As noted above, the head assembly comprises generally an adjustable-width guide assembly 140, a central roller member 142, and a cutting member 144 (not shown in FIG. 9, but shown in FIG. 8). These are supported by a side plate 146 which is mounted to and extends downwardly from the lower end of the handle member 114. The lower corners of the side plate extend in forward and rearward directions, and the cutter member 144 is mounted to the rearwardly extending corner so that this extends perpendicularly with respect to the axis of the handle member, and across the upper edge of the joist when the tool is placed thereon.

At the forward corner of the side plate there is an axle member 148, and this also extends transversely with respect to the axis of the handle member so as to perpendicularly cross the upper edge of the joist. A short spacer 150 is mounted about the base of the axle member at side plate 146, and this serves to offset the guide assembly and roller member laterally from the handle so that these are in vertical alignment with spool assembly 112, thus avoiding lateral bending or twisting of the tape as this is lead into the head assembly.

For reasons which will be discussed below, axle member 148 is preferably square or rectangular in cross section, and this extends through both the roller member 142 and the adjustable-width guide assembly 140. This latter comprises generally first and second compound wall assemblies 160 and 162, which depend from the axle member so as to flank the central roller member. Each of the compound wall assemblies is made up of a plurality of individual wall segments 164, there being five of these in each of the wall assemblies shown in FIG. 9. Each of the wall segments is a flat, vertically aligned plate, and these are free to move independently in a vertical direction by sliding past one another. Each of the wall segments is provided with a central slot 166 in the form of an elongated rectangle, and the width of this corresponds generally to the width of the square axle member 148. The permits the wall segments to be displaced vertically until the axle member reaches the upper or lower ends of the slots, so that these can be positioned to define a downwardly-extending guide area for receiving the edge of the joist; then, as the tool is pushed along the edge of the joist, the walls of the slots will abut the square axle member so as to prevent rotation of the wall member, thus preserving the configuration of the guide area.

As was noted above, the roller member 142 is positioned between the wall assemblies 160, 162. The roller member is preferably configured so that this can rotate about the axle member as the tool is being used, thus reducing the friction against the non-adhesive side of the tape. This may be facilitated by providing roller member 142 with an inner sleeve member 154 which extends annularly through bore 152 and receives the axle member 148. The ends of inner sleeve 154 extend just slightly beyond those of the outer roller member (i.e., the inner sleeve is just slightly longer than the outer roller member0, so that the ends of the sleeve member abut the adjacent wall segments of the two wall assemblies when the wing nut is tightened; this leaves the outer roller member free to rotate about the inner sleeve, while the latter transmits the compressive force through to the wall assembly opposite the wing nut. Preferably, the inner sleeve member may be formed of a suitable low-friction material, such as nylon or Teflon TM, while the outer roller member is formed of metallic or other tubing which is both durable and moves over the non-adhesive side of the tape with a minimum of friction.

The outer end of axle member 148 forms a threaded stud 168, and this is engaged by a wing nut 170. A flat washer 172 is positioned between the outermost of the wall segments 164 and the wing nut 170, so as to facilitate rotation of the wing nut, and also to enhance the distribution of force from the wing nut to these. Similarly, the force on the other end of the assembly is distributed by the spacer 150, and this may preferably have a diameter similar to that of washer 172. Thus, when the wing nut 170 is slackened, the wall segments 164 are freed from frictional engagement with one another, so that these can be displaced independently in a vertical direction. Then, when the desired width of the receiving area has been achieved, wing nut 170 is tightened again, and this forces the plate-like wall segments into frictional engagement with one another so as to lock them in their respective positions while the tool is being used. FIG. 10A shows the head assembly 130 in its initial configuration, with all of the wall segments being extended downwardly, as this may be achieved by simply loosening the wing nut 170 and letting the segments 164 drop until the axle member reaches the upper limits of the slots. In this configuration the wall segments all extend a significant distance (e.g., $\frac{3}{4}$") below the roller member 142, and also below the strip of tape 176 which extends under the roller member, and so these define a guide slot 180 for receiving the edge of the joist. However, as can be seen in FIG. 10A, the guide slot is at its narrowest width in this initial configuration (e.g., $1\frac{1}{4}$"), and this may be insufficient for the edge of a relatively wider joist 182.

In order to adjust the width of the guide slot, then, the operator simply centers the assembly on the edge of the particular joist 182 as shown in FIG. 10B, and then, leaving wing nut 170 loosened, lowers the head assembly 130 against the edge of the joist. As this is done, those wall segments 164 which abut the upper edge of the joist—(i.e., the two wall segments 164*a–b* and 164*c–d* on either side of the roller member in the illustrated example)—remain stationary, while those wall segments which are positioned further outwardly from the roller member clear the sides of the joist, and are free to move downwardly together with the rest of the head assembly. This continues until the axle member reaches the lower ends of the slots in the lifted wall segments 164A–D; wing nut 170 is then tightened so as to force the various wall segments into frictional engagement with one another and so lock them in position. Thus, the lifted wall segments 164*a–d* are essentially "removed" from the guide slot 180 during the adjustment procedure, leaving the remaining depending segments to define a relatively wider guide slot.

The inner wall segments which have been displaced upwardly from the guide slot area to the fullest extent nevertheless extend a short distance below the lower surface of roller member 142. This distance is preferably about equal to or slightly less than the thickness of tape strip 176 when this is partially compressed beneath the roller member (e.g., about 1/32"). Thus, the lower edges of the displaced wall segments essentially form a secondary guide slot 182 which receives the tape strip 176 and centers this on the upper edge of the joist, regardless of the width of the joist which is received in the primary guide slot 180. This provides the tool with a significant advantage in that one width of tape can be used with several sizes of joists, without fear that this will be laid excessively off center on the wider joists.

Thus, it will be understood that the guide slot is adjustable in width anywhere from the narrowest opening which is available between the innermost wall segments 164, to the widest opening which is available between the outermost of these segments. Of course, the range of available widths can be varied by increasing or decreasing the number of segments in each wall assembly, and if finer gradations are desired, the plates can be made in lesser thicknesses. Also, it should be understood that while the wall segments illustrated in FIG. 9 are in the shape of circular washers, which provides the wall segments with a smooth, cylindrical exterior which is easy to handle and does not catch on the joists, these wall segments may be formed in whatever suitable shape is desired. Also, while the slots in the illustrated wall segments are rectangular, so that these correspond to the square axle member 148, it will be understood that these too may have some other configuration, so long as they engage the axle member to prevent rotation about this.

As previously noted, the head assembly 130 is also provided with a cutter member 144. When the operator is applying the tape, he holds the handle in a relatively upright position and pushes this in a forward direction, so that the tape strip passes beneath the roller member 142 and then out the back of the assembly beneath the cutter blade. Then, when the operator reaches the point where he wishes to cut the strip off, he simply pushes the handle portion of the tool in a downward direction; as he does this, the head assembly pivots about the roller member 142 on top of the joist, so that the cutter blade 164 moves downwardly into contact with the tape 196 on the joist. This forces the cutting edge 170 of the blade into the tape strip, cutting this off. The angle of the cutter blade is preferably selected so that this enters the tape at an angle not far from perpendicular, thus ensuring a clean cut.

Having described the invention in its preferred embodiments, it will be clear that changes and modifications may be made without departing from the spirit of the invention. It is therefore not intended that the words used to describe the invention nor the drawings illustrating the same be limiting on the invention. Rather, it is intended that the invention only be limited by the scope of the appended claims.

What is claimed is:

1. A tool for applying adhesive cushioning tape to an edge of a floor joist for supporting floor decking, so as to prevent squeaking due to movement of said decking relative to said joist, said tool comprising:

a handle member configured to be held by an operator;

a roller member mounted to a lower end of said handle member so as to enable said operator to apply downward pressure on said roller member against said edge of said joist;

a spool member mounted to said handle member for unwinding a roll of said tape so that an adhesive side of said tape is exposed;

a guide member mounted to said lower end of said handle member and having a guide area defined by first and second spaced apart wall members for engaging said edge of said joist and guiding said roller for forward movement thereon, at least one said wall member being a compound wall structure comprising a plurality of plate-like wall segments stacked together in side-by-side relationship and mounted to said guide member so as to be individually displaceable thereon away from said guide area, so that the width of said guide area is adjustable to accommodate joists of various widths by selectively displacing individual said wall segments which lie adjacent said guide area; and means for feeding said tape which is unwound from said roll under said roller member so that said adhesive side of said tape is pressed against said edge of said joist by said downward pressure on said roller member.

2. The tool of claim 1, further comprising cutter means mounted to said lower end of said handle member for cutting said tape on said upper edge of said joist.

3. The tool of claim 1, wherein said spool member comprises a spool for holding a roll of said tape, said spool being rotatably mounted to said middle portion of said handle member above said roller member.

4. The tool of claim 3, wherein said means for feeding said tape under said roller member is said guide member.

5. The tool of claim 1, wherein said roller member is positioned intermediate said wall members and over said guide area.

6. The tool of claim 5, wherein said guide member further comprises:

means for selectively locking said side-by-side wall segments together so that in a released position said wall segments are selectively displaceable so as to adjust said guide area to a selected width, and in a locked position said wall segments are locked together so as to maintain said guide area at said selected width.

7. The tool of claim 6, wherein said guide member further comprises an axle member extending through said wall members and said roller member.

8. The tool of claim 7, wherein said axle member extends through elongate slots in said segments of said wall members, said axle member being configured to permit vertical displacement of said segments relative to said axle member, but to cooperatively engage said slots so as to prevent said segments from rotating about said axle member.

9. The tool of claim 8, wherein said axle member is substantially square in cross section, and said slots in said wall segments are each substantially rectangular in shape.

10. The tool of claim 8, wherein said wall segments mounted on said axle member form first and second said compound wall members on either side of said roller member.

11. The tool of claim 10, wherein said means for locking said wall segments together comprises:

a base member mounted on a first end of said axle member so as to abut an outermost said wall segment of said first wall member; and an adjustable nut member threadably mounted to a second end of said axle member so as to abut an outermost said wall segment of said second wall member, so that in response to slackening of said nut member said segments of wall members are released so as to permit adjustment of said width of said guide area, and in response to tightening of said nut member said wall members are compressed between said nut member and said base member against ends of said roller member so that said wall segments are forced into locking frictional engagement with one another.

12. The tool of claim 11, wherein said roller member comprises:

an outer sleeve member mounted about said axle member so that said outer sleeve member rotates as said tape is pressed against a said joist thereby; and an inner sleeve member mounted annularly within said outer sleeve member and around said axle member, said inner sleeve member having first and second end portions which protrude beyond the ends of said outer sleeve member, so that as said nut member is tightened, said first and second wall members are compressed against said end portions of said inner sleeve member and said outer sleeve member is left free to rotate about said inner sleeve member.

13. A tool for applying adhesive cushioning tape to an edge of a floor joist for supporting floor decking, so as to prevent squeaking due to movement of said decking relative to said joist, said tool comprising:

a handle member configured to be held by an operator, said handle member having upper and lower ends and a middle portion;

a roller member mounted to said lower end of said handle member so as to enable said operator to apply downward pressure on said roller member against said edge of said joist;

a spool member mounted to said handle member for unwinding a roll of said tape so that an adhesive side of said tape is exposed;

a guide member mounted to said lower end of said handle member and having a guide area for engaging said edge of said joist so as to guide said roller along said edge of said joist as said roller is moved in a forward direction, said guide area being adjustable in width so as to enable said guide member to engage edges of joists having various widths, said guide member comprising:

first and second parallel wall members which are spaced apart so as to define said guide area intermediate said wall members, said roller member being positioned intermediate said wall members and over said guide area, at least one said wall member being a compound wall structure comprising a plurality of wall segments positioned in side-by-side relationship, said wall segments each being selectively displaceable so that the width of said guide area is adjustable by selectively displacing wall segments which lie adjacent said guide area; and means for selectively locking said side-by-side wall segments together so that in a released position said wall segments are selectively displaceable so as to adjust said guide area to a selected width, and in a locked position said wall segments are locked together so as to maintain said guide area at said selected width; and means for feeding said tape which is unwound from said roll under said roller member so that said adhesive side of said tape is pressed against said edge of said joist by said downward pressure on said roller member.

14. The tool of claim 13, wherein said guide member further comprises an axle member extending through said wall members and said roller member.

15. The tool of claim 14, wherein said axle member extends through elongate slots in said segments of said wall members, said axle member being configured to permit vertical displacement of said segments relative to said axle member, but to cooperatively engage said slots so as to prevent said segments from rotating about said axle member.

16. The tool of claim 15, wherein said axle member is substantially square in cross section, and said slots in said wall segments are each substantially rectangular in shape.

17. The tool of claim 15, wherein said wall segments are flat, plate-like members stacked together in side-by-side relationship to form first and second said wall members on either side of said roller member.

18. The tool of claim 17, wherein said means for locking said wall segments together comprises:

a base member mounted on a first end of said axle member so as to abut an outermost said wall segment of said first wall member; and an adjustable nut member threadably mounted to a second end of said axle member so as to abut an outermost said wall segment of said second wall member, so that in response to slackening of said nut member said segments of wall members are released so as to permit adjustment of said width of said guide area, and in response to tightening of said nut member said wall members are compressed between said nut member and said base member against ends of said roller member so that said wall segments are forced into locking frictional engagement with one another.

19. The tool of claim 18, wherein said roller member comprises:

an outer sleeve member mounted about said axle member so that said outer sleeve member rotates as said tape is pressed against a said joist thereby; and an inner sleeve member mounted annularly within said outer sleeve member and around said axle member, said inner sleeve member having first and second end portions which protrude beyond the ends of said outer sleeve member, so that as said nut member is tightened, said first and second wall members are compressed against said end portions of said inner sleeve member and said outer sleeve member is left free to rotate about said inner sleeve member.

* * * * *